US012637256B2

(12) United States Patent
Mutha

(10) Patent No.: US 12,637,256 B2
(45) Date of Patent: May 26, 2026

(54) FLEXIBLE TUBE CONTAINER

(71) Applicant: ALBEA SERVICES, Gennevilliers (FR)

(72) Inventor: Nitin Mutha, Gennevilliers (FR)

(73) Assignee: Albea Services, Gennevilliers (FR)

( * ) Notice: Subject to any disclaimer, the term of this patent is extended or adjusted under 35 U.S.C. 154(b) by 326 days.

(21) Appl. No.: 18/578,236

(22) PCT Filed: Jul. 29, 2022

(86) PCT No.: PCT/EP2022/071460
§ 371 (c)(1),
(2) Date: Jan. 10, 2024

(87) PCT Pub. No.: WO2023/007006
PCT Pub. Date: Feb. 2, 2023

(65) Prior Publication Data

US 2024/0300702 A1 Sep. 12, 2024

(30) Foreign Application Priority Data

Jul. 29, 2021 (EP) ..... 21188602

(51) Int. Cl.
*B65D 35/08* (2006.01)
*B65D 35/44* (2006.01)
*B65D 65/40* (2006.01)

(52) U.S. Cl.
CPC ..... *B65D 35/08* (2013.01); *B65D 35/44* (2013.01); *B65D 65/40* (2013.01)

(58) Field of Classification Search
CPC ..... B65D 35/08; B65D 35/44; B65D 65/40; B32B 7/12; B32B 27/306; B32B 2250/40; B32B 2270/00; B32B 2307/72; B32B 2307/7246; B32B 2307/732; B32B 27/08; B32B 27/20; B32B 27/32; B32B 2597/00; B32B 1/08
See application file for complete search history.

(56) References Cited

FOREIGN PATENT DOCUMENTS

| | | | |
|---|---|---|---|
| KR | 20100138133 | A | 12/2010 |
| WO | 0066654 | A1 | 11/2000 |
| WO | 2008135755 | A1 | 11/2008 |
| WO | 2021052563 | A1 | 3/2021 |

OTHER PUBLICATIONS

PCT/EP2022/071460, "International Search Report and Written Opinion", Nov. 28, 2022, 12 pages.

*Primary Examiner* — Michael C Miggins
(74) *Attorney, Agent, or Firm* — Morgan, Lewis & Bockius LLP

(57) ABSTRACT

A flexible tube container comprising tube head and a skirt formed from a multi-layer polymeric material produced as a blown film, the skirt comprising a longitudinal weld or join, the multi-layer polymeric material comprising a thickness of between 200 and 400 micrometers, said multi-layer polymeric material comprising two polyethylene (PE) based surface layers, at least two non-metallic barrier layers, and a plurality of PE based inner layers between said surface layers, wherein the multi-layer polymeric material comprises pigments in several inner layers.

14 Claims, 4 Drawing Sheets

[Fig. 1]
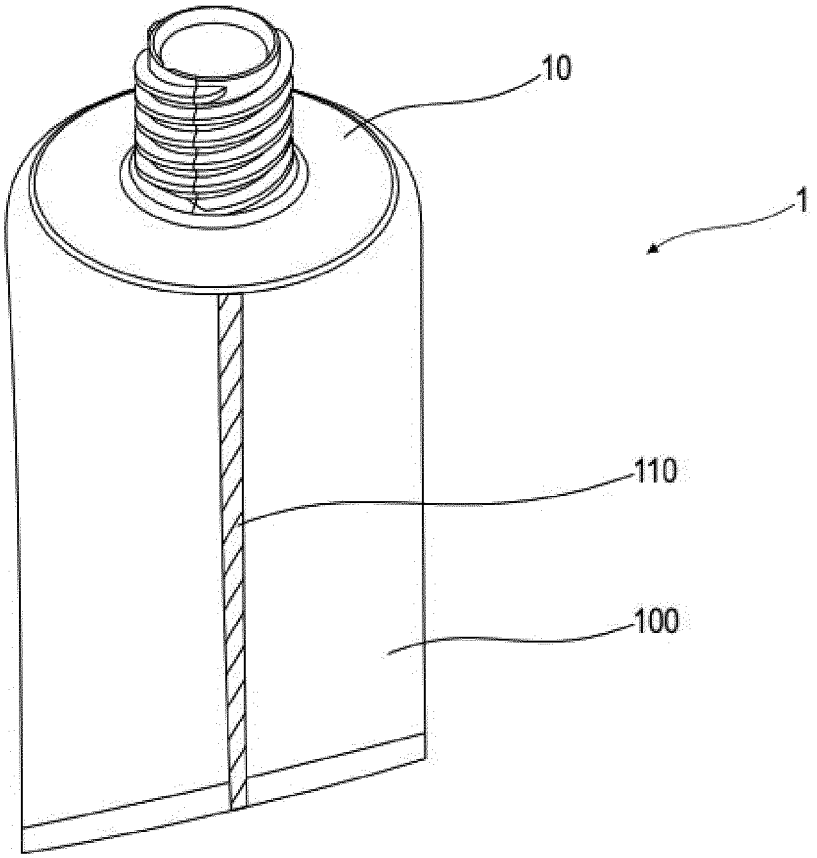
[Fig. 2]
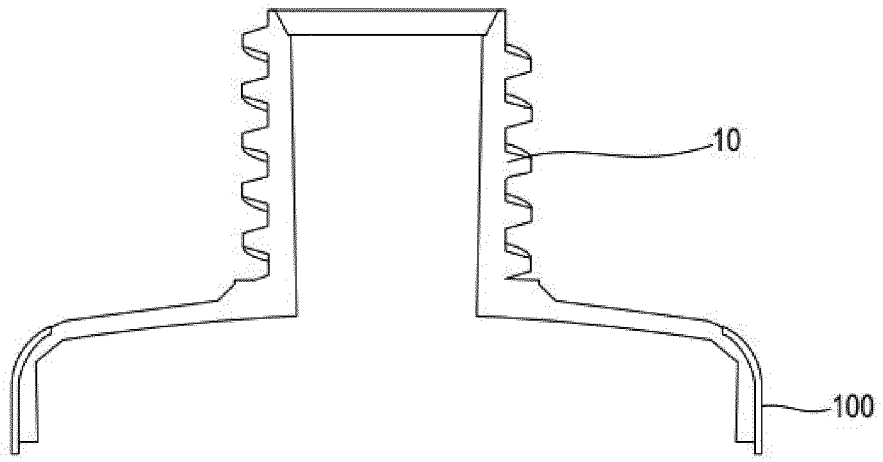

[Fig. 3]
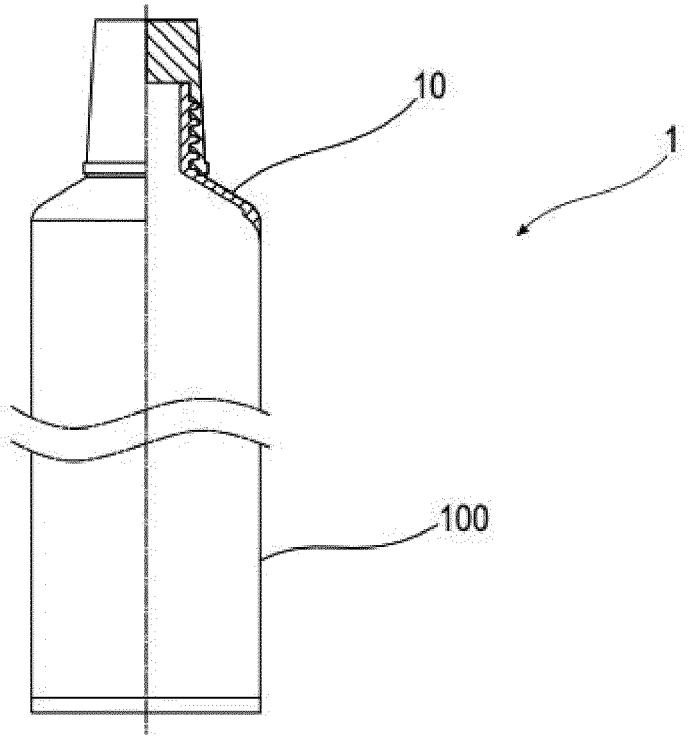
[Fig. 4]
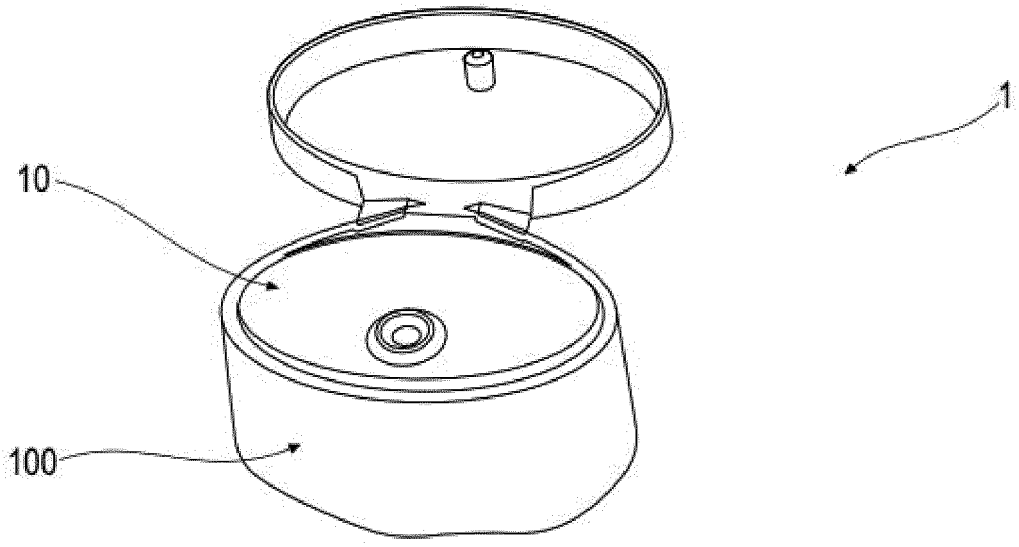

[Fig. 5]
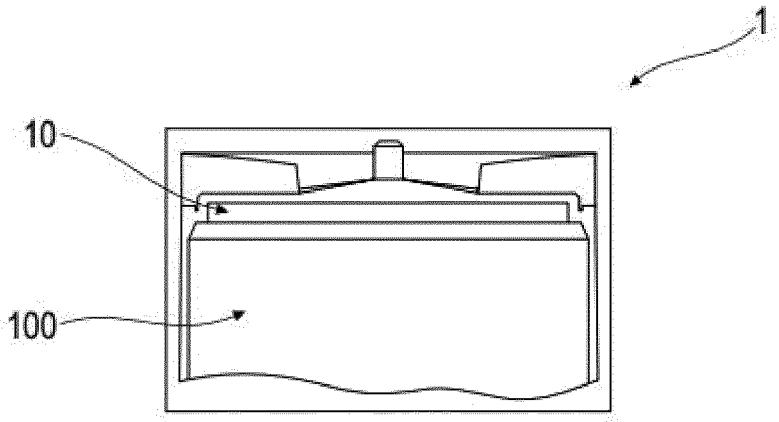
[Fig. 6]
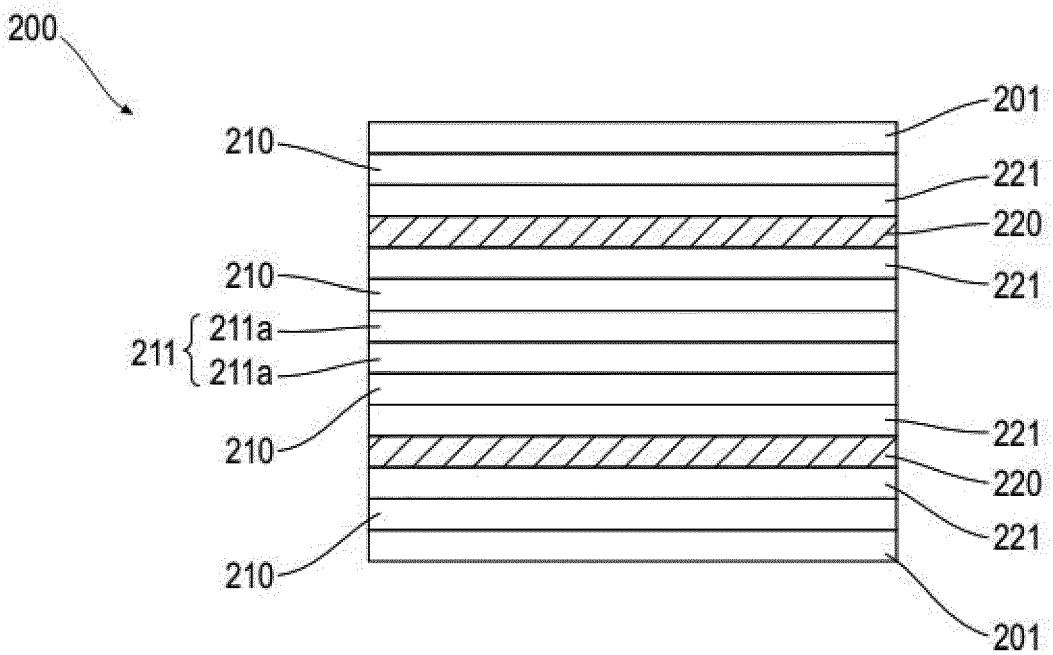

[Fig. 7]
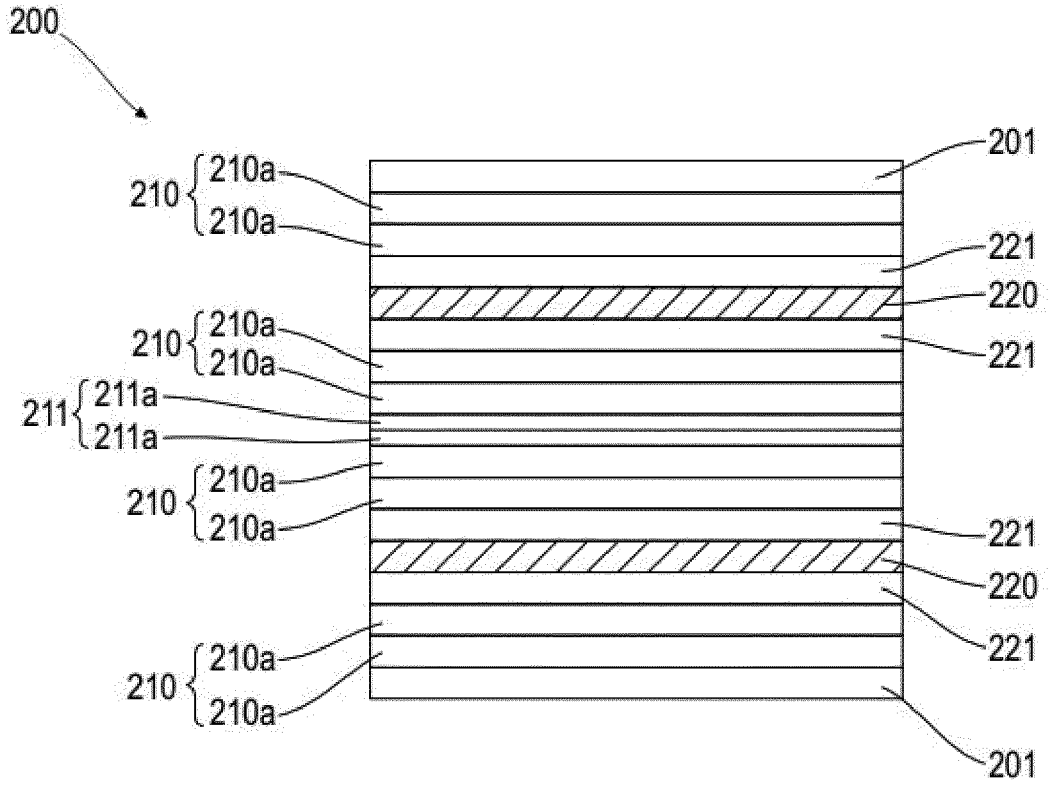

FLEXIBLE TUBE CONTAINER

CROSS-REFERENCE TO RELATED APPLICATIONS

This application is the National Stage of International Application No. PCT/EP2022/071460, filed Jul. 29, 2022, which claims priority to European Application No. 21188602.3, filed Jul. 29, 2021, and the contents of which are incorporated by reference.

The present invention relates to a flexible tube container formed from blown film multi-layer polymeric material. Said tubes are designed to store and distribute liquid to pasty products. These flexible tubes include a head and a flexible skirt that is itself obtained from a "laminated" strip, including several layers of different plastics. The plane strip used within the context of this invention is cut out from a film which includes several layers of different plastics, which combine the various functions that a tube skirt must fulfill such as flexibility, dead-fold properties, act as a barrier to diffusion, be able to accept printing, etc.

It is known from the state of the art multi-layer flexible tube skirt, primarily comprising a polymeric intermediate layer with a barrier effect with regard to oxygen and to flavors, typically made from EVOH (polymeric ethylene-vinyl alcohol)), said layer being sensitive to moisture, and on each face of this intermediate layer, one or more polymeric layers containing polyolefin, all said layers being continuously bonded to each other. Such tube skirt can also comprise a layer comprising pigments in order to control the opacity of the skirt.

A typical drawback of plastic material is that it can become yellowish through time. This yellowing of the plastic can also affect the tube skirt. Such yellowing is problematic as it does not give a quality image to the product.

The yellowing of the plastic tube skirt can be influenced by light exposure, due notably to UV beam. The yellowing of the skirt is more significant for skirt with less opacity. Thus, increasing the opacity of the skirt will helps to mask a possible yellowing of the skirt. However, pigments may alter the mechanical properties of the polymeric layer they are mixed with. Thus, increasing the quantity of pigment in one specific layer may cause processability issues.

The yellowing of the plastic tube skirt can also be influenced by moisture. The moisture can come from the storage environment of the tube and from the product contained by the tube. Some polyolefin, such as polyethylene (PE), have relative moisture barrier effect. In particular, a layer made of PE may have different properties depending on the type of PE which is used. PE with low density are easy to process but are poor moisture barrier, whereas PE with higher density have better moisture barrier properties but are more difficult to process. Therefore, none of these are entirely satisfactory.

The present invention attempts to solve at least one of the above mentioned problems and propose a flexible tube container comprising tube head and a skirt formed from a multi-layer polymeric material produced as a blown film, the skirt comprising a longitudinal weld or join, the multi-layer polymeric material comprising a thickness of between 200 and 400 micrometers, said multi-layer polymeric material comprising two PE based surface layers, at least two non-metallic barrier layers, and a plurality of PE based inner layers between said surface layers, wherein the multi-layer polymeric material comprises pigments in several inner layers.

It has been discovered that, for the same overall quantity of pigment in the tube skirt, when the pigments are distributed among several layers instead of a single layer, the opacity is increased. Therefore, the flexible tube according to the invention allows to increase the opacity of the tube skirt while avoiding any processability issues. The risk of yellowing of the skirt is therefore reduced.

The invention can also comprise any of the following features taken individually or in any technically possible combination:

- the pigments are distributed in 2n inner layers, n being an integer,
- the multi-layer polymeric material comprises from 3% to 7% in mass of pigment,
- the pigment comprises titanium dioxide ($TiO_2$),
- the surface layers are made of MDPE,
- each inner layer comprise mixture of different type of polyethylene, the ratio of different type of polyethylene being selected in order to balance the moisture barrier effect and the processability,
- the inner layers comprise mixture of LLDPE and MDPE,
- the inner layers comprise mixture of LDPE and HDPE,
- each inner layer comprise HDPE,
- inner layers comprise sub-layers,
- the sub-layers are made of same material,
- the at least two non-metallic barrier layers are made of EVOH,
- the multi-layer polymeric material comprises 2n barrier layers,
- the multi-layer polymeric material comprises tie layers on both side of each barrier layer,
- multi-layer polymeric material has a symmetrical structure with respect to its median plane,
- the multi-layer polymeric material comprises pigments in each inner layers,
- one specific type of PE represents at least 60% in mass of the laminated material.

The invention will be better understood thanks to the following description which is only indicative and which is not intended to limit said invention, accompanied with the following figures:

FIG. 1 is a schematic representation of a flexible tube container according to an embodiment of the present invention FIG. 2 is a sectional view of part of FIG. 1

FIG. 3 is a schematic representation of a flexible tube container according to a second embodiment of the present invention, FIG. 4 is a schematic representation of a flexible tube container according to another embodiment of the present invention, FIG. 5 is a sectional view of part of FIG. 4, FIG. 6 is a schematic diagram of the layers that form the laminate according to an embodiment of the present invention, FIG. 7 is a schematic diagram of the layers that form the laminate according to a second embodiment of the present invention.

In the context of the invention, the following definitions and abbreviations are used. As used herein, the terms "outer", "inner", "upper" and "lower", and the like, used with respect to the various layers refer to the laminated material with the intended outer or upper surface uppermost and the intended inner or lower (product-contacting) surface lowermost. In addition, these terms and the terms "over", "under" or "on" do not imply that the layers are necessarily directly in contact. For example, the upper layer being "formed on" the barrier layer does not preclude the presence of one or more other intervening layers located between the upper layer and the barrier layer. Furthermore, layers may be provided under the inner layer, i.e. between the inner layer and the product, or above the outer layer (like decorative layers).

The term "container" is used herein to refer to an item which may contain a product. Such products are usually liquids, gels or pastes. Preferred containers include tubes and pouches. The container may further comprise a lid or a cap and, if necessary, attachment means for the lid or cap (such as a tube head or shoulder) before it forms a useful commercial container. As a consequence, the laminated material of the invention can form a tube skirt, an insert of a tube head or a combination thereof.

The term "flexible laminate" as used herein describes a laminate or a container made thereof which can bend or be bent easily and which does not break (unless it is bent too much). Herein in connection with the containers the term flexible indicates that if the container is subjected to a force, for example, by being filled with a liquid, or by applying pressure with a finger or a hand, it will change its form without breaking. A flexible container can also be considered to be a "squeezable" container.

The term "tie layer" refers to a layer which is placed between two layers with the object of ensuring that the two layers are joined together.

The term "polymer" refers to a large molecule, or macromolecule, composed of many repeated subunits.

The term "polyolefin" refers to any of a class of polymers produced from a simple olefin as a monomer.

The term "PP" refers to polypropylene.

The term "PE" refers to polyethylene.

The term "LDPE" refers to low density polyethylene.

The term "LLDPE" refers to linear low density polyethylene.

The term "MDPE" refers to medium density polyethylene.

The term "HDPE" refers to high density polyethylene.

As illustrated in FIGS. 1 to 5, the invention relates to a flexible tube container 1 comprising a tube head 10 and a skirt 100 formed from a multi-layer polymeric material 200 produced as a blown film. Advantageously, as represented at FIG. 3, the flexible tube container 1 can also comprise a cap 20.

The tube head 10 comprises a wall with a distribution opening and is attached or linked to the tube skirt 100. According to an embodiment, the head 10 can comprise a shoulder 11 and a neck 12. The neck advantageously comprises thread. The cap can be screwed on the neck in order to block the distribution opening.

According to another embodiment, the cap can be snapped on the neck, the neck comprising snap function such as an annular rib cooperating with flanges or tabs of the cap.

According to yet another embodiment represented at FIGS. 4 and 5, the tube can comprise a head 10 with no neck. In this configuration, the head comprises only the wall with a distribution opening, this wall being attached directly to the skirt. This shoulderless configuration allows to reduce the quantity of material used to form the head.

According to an embodiment, the tube 1 can also comprise an insert located inside the tube 1 and attached to the internal surface of the head 10. In this case, the cap advantageously comprise a punch configured to pierce or cut the insert during the first use of the tube 1. More advantageously, the tube 1 according to this embodiment comprises a ring mounted on the head. Said ring allows to maintain the cap in a first position, called waiting position, in which the pinch is kept at distance from the insert.

As illustrated in FIG. 1, the skirt 100 comprises a longitudinal weld or join 110. Advantageously, this longitudinal weld 110 is obtained by overlapping the edges of laminate of a multi-layer polymeric material 200 forming the skirt 100. More particularly, portions of the laminate are folded onto each other in a tubular configuration such that a first side edge of the laminate covers a second side edge of the laminate. Then, an upper surface of the laminate is in facing contact with a lower surface of the laminate. An overlap side seam is formed by means of heating the laminate such that the upper surface of the laminate is bonded to the lower surface of the laminate. The overlap side seam forms the longitudinal weld 110. Said longitudinal weld 110 can be visible from the outside of the tube 1. According to an embodiment, the longitudinal weld 110 is non visible.

As represented in FIGS. 2 and 3, said flexible tube skirt 100 is intended to be fixed to the tube head 10 in order to form the flexible tube 1. The tube head 10 is advantageously overmoulded on the skirt 100. The skirt 100 is advantageously fixed to the shoulder periphery. Said tube head 10 is advantageously made of PE but can be made in any other suitable material such as PP (polyproylene). The tube head can be produced as a separate piece of plastic and then attached to the skirt by heating the edge of the shoulder and the edge of the skirt and compress them together.

Embodiments of the structures of the multi-layer polymeric material 200 according to the invention are illustrated at FIGS. 6 and 7. Said multi-layer polymeric material 200 are advantageously manufactured according to the method disclosed in the international application WO2008/065280 which is hereby incorporated by reference. Said multi-layer polymeric material 200 comprises two PE based surface layers 201. The surface layers 201 correspond to the outermost layer and the innermost layer of the multi-layer polymeric material 200.

The multi-layer polymeric material 200 comprises at least two non-metallic barrier layers 220.

The multi-layer polymeric material 200 comprises a plurality of PE based inner layers 210 between the surface layers 201. The inner layers can be made of several sub-layers 210*a*, preferentially two sub-layers, not necessary of the same thickness, but of the same material, i.e. consisting of a polymer or a mixture of several polymers in identical proportions, said polymer(s) being produced from monomers with the same chemical composition and substantially the same average molar mass. The sub-Layers 210*a* are particularly detectable during the manufacture of the multi-layer polymeric material 200.

The multi-layer polymeric material 200 forming the skirt 100 of the tube 1 according to the present invention comprises pigments in several inner layers 210 or sub-layers 210*a*. Consequently, as the pigments are distributed among several layers (or sub-layers) instead of a single layer, the opacity is increased. This technical effect is illustrated by the opacity comparison between different laminated materials presented in table 1 below.

TABLE 1

| Web Type | Total Thickness (μm) | No. of EVOH Layers | Total EVOH Thickness (μm) | OTR (cc/m2 · day at 30° C., 50% RH | HDPE (Density > 0.96 g/cc) (Wt %) | MVTR (g/m2 · day at 38° C., 100% RH | Pigment (weight %) | White MB added in no. of layers | Opacity (%) | Yellowing of Skirt due to aggressive Hair dye bulk in accelerated tests (e.g. Garnier Olia 1.0, 45° C. 2 month) |
|---|---|---|---|---|---|---|---|---|---|---|
| 1. Comparative example 1 | 250 | 1 | 15 | 0.48 | 31.8% | 0.48 | 12.49% | 3 | 96% | Not tested |
| 2. Comparative example 2 | 250 | 1 | 16 | 0.096 | 21.1% | 0.58 | 5.3% | 4 | 90.42% | ++++ |
| 3. Example 1 | 250 | 2 | 16 (8 × 2 layers) | 0.068 | 0% | 0.823 | 5.8% | 8 | 91.39% | +++ |
| 4. Comparative example 3 | 250 | 1 | 16 | 0.008 | 60.4% | 0.29 | 3.9% | 4 | 86.79% | Not tested |
| 5. Example 2 | 250 | 2 | 16 (8 × 2 layers) | 0.004 | 60.7% | 0.24 | 3.9% | 8 | 86.85% | + |
| 6. Example 3 | 250 | 2 | 20 (10 × 2 layers) | <0.002 (below least count) | 59% | 0.26 | 3.8% | 8 | 86.8% | + |
| Example 4 | 220 | 2 | 16 (8 × 2 layers) | <0.002 (below least count) | 60.7% | 0.28 | 3.9% | 8 | 87% | + |
| Example 5 | 220 | 2 | 16 (8 × 2 layers) | — | 58.1% | — | 4.3% | 4 | — | |
| Example 6 | 200 | 2 | 16 (8 × 2 layers) | — | 59.1% | — | 4.55% | 4 | — | |

OTR corresponds to the Oxygen Transmission Rate. This parameter is measured with oxygen permeation testing analyzer such as MOCON, the measure being notably realized according to the standard test method ASTM F1927.

MVTR corresponds to the Moisture Vapor Transmission Rate. This parameter is also measured with MOCON analyzer, the measure being notably realized according to the standard test method ASTM F1249.

In column 6, the HDPE presents a density range higher than 0.96. The indicated weight % is calculated for the tube skirt.

The pigment used in these tests correspond to white Master Batch. The white Master Batch is a solid additive for plastic used for coloring plastics, it comprises 70% in mass of titanium dioxide (TiO2). The indicated weight % is calculated for the tube skirt.

The Opacity is measured with benchtop spectrophotometers, notably on X-Rite i7, according to an internal method.

Concerning the yellowing of the skirt, the more "+" indicated in the table, the more the skirt is yellow. This feature is a visual observation.

As it can be seen in this table 1, when the number of layers (or sub-layers) comprising pigment increases, the general opacity of the multi-layer polymeric material 200 increases. More particularly, a similar opacity can be obtained with less pigment when said pigment is distributed in several layers (or sub-layers). In particular, it was observed that good opacity results are obtained when a layer comprises several thin sub-layers, as in samples 5 and 6. Indeed, the overall quantity of pigment in sample 1 is much higher than the other samples. Sample 1 comprises pigment only in four layers. It is noted that, when the pigments are distributed in a higher number of layers (or sub-layers), it is possible to obtain a satisfactory opacity with significantly less pigments (see notably sample 6 with only 3.8% in weight of pigment).

As mentioned above, if the quantity of pigment is too important in a single layer, said layer may be difficult to process. As the overall quantity of pigment is split into the inner layers 210 (or sub-layers 210*a*), for one inner layer 210 as such, the quantity of pigment become sufficiently low to avoid processability issue. Consequently, each inner layer can be easily produced during manufacturing of multi-layer polymeric material 200 by blown film process.

The total thickness of the multi-layer polymeric material 200 does not influence its quality. A thinner multi-layer polymeric material 200, for example of a total thickness of 200 or 220 micrometers, has similar results as a multi-layer polymeric material 200 with a total thickness of 250 μm.

Therefore, the flexible tube 2 according to the invention allows to increase the opacity of the tube skirt 100 while avoiding any processability issues. This technical feature helps to treat the symptom of yellowing of the skirt. The visible yellowing of the skirt is therefore reduced and the quality image of the product is improved.

As an overall view, the multi-layer polymeric material 200 contains a sufficiently high quantity of pigment to obtain a satisfactory opacity.

In a preferred embodiment, the quantity of pigment is evenly distributed into each inner layer.

Preferably, the multi-layer polymeric material 200 comprising a thickness of between 200 and 400 micrometers. Advantageously, the multi-layer polymeric material comprising a thickness of between 200 and 370 micrometers, preferably between 200 and 350 micrometers, more preferably between 200 and 330 micrometers and more preferably between 200 and 250 micrometers.

Advantageously the multi-layer polymeric material 200 has a symmetrical structure with respect to its median plane. More particularly, the multi-layer polymeric material 200 has symmetrical layers with substantially the same thickness and substantially made up of the same plastic, i.e. consisting of a polymer or a mixture of several polymers in identical proportions, said polymer(s) being produced from monomers with the same chemical composition and substantially the same average molar mass. Here, it is attempted to limit the heterogeneous behavior of the various layers by aiming at as perfect as possible a symmetry in relation to the median plane of the multi-layer polymeric material 200, not only geometrical but also concerning the material used, it not being deemed sufficient to have the same chemical composition of the basic monomer(s).

Preferably, the pigments are distributed in 2n inner layers, n being an integer.

Advantageously, the multi-layer polymeric material 200 comprises from 3% to 7% in mass of pigment. This proportion of pigments allows to obtain a sufficient opacity while still keeping satisfactory mechanical properties.

As illustrated at FIGS. 6 and 7, the surface layers 201 are preferably made of MDPE. It has been determined by the applicant that the use of MDPE surface layers allows good welding and sealing behavior, especially when forming the longitudinal weld 110.

Advantageously, the multi-layer polymeric material 200 comprises a central layer 211. When there is a single central layer 211, the median plane of the multi-layer polymeric material 200 is located at the center of said central layer 211.

Alternatively, the multi-layer polymeric material 200 can comprise two central layers 211.

Alternatively, the multi-layer polymeric material 200 can comprise one central layers 211 made of two sub-layers 211*a*. The sub-layers are not necessary of the same thickness, but they are of the same material, i.e. consisting of a polymer or a mixture of several polymers in identical proportions, said polymer(s) being produced from monomers with the same chemical composition and substantially the same average molar mass.

In this configurations, the median plane of the multi-layer polymeric material 200 is located between said central layers 211. The sub-Layers 211*a* are particularly detectable during the manufacture of the multi-layer polymeric material 200.

Advantageously, each inner layer 210 of the multi-layer polymeric material 200 forming the skirt 100 of the tube 1 according to the invention comprises mixture of different type of PE, more particularly, PE with different density. Indeed, PE with higher density allows a better moisture barrier effect but are more difficult to process than the PE with lower density. In the same way, PE with lower density are weak moisture barrier but are easier to process. Therefore, the mixture of PE, i.e. the ratio of different type of PE, is advantageously selected in order to balance the moisture barrier effect and the processability. A better moisture barrier effect will help to reduce the yellowing of the skirt. This technical effect is illustrated by the moisture barrier comparison between different laminated materials presented in table 1 above. As can be seen when comparing the Moisture Vapor Transmission Rate (MVTR) of the different samples, samples 4, 5 and 6 have a less important MVTR than sample 1, 2 and 3. The multi-layer polymeric material 200 according to samples 4, 5 and 6 comprises a higher percentage of High Density PE than the multi-layer polymeric material 200 according to samples 1, 2 and 3. The increased proportion of High Density PE helps to improve the moisture barrier effect and, consequently, helps to reduce the yellowing of the skirt 100. This feature helps to treat the cause of the yellowing of the skirt.

According to an embodiment illustrated in FIG. 6, the inner layers 210 comprise HDPE or a mixture of MDPE and LLDPE.

According to an embodiment illustrated in FIG. 7, the inner layers 210 comprise HDPE or a mixture of HDPE and LDPE.

The mixture presented in these embodiments allows for a better touch and less stiffer skirt. Said mixtures also allow for less cracking noise when the tube 1 is squeezed.

Advantageously, each inner layer 210 comprise HDPE.

Preferably, the at least two non-metallic barrier layers 220 are made of EVOH. Such barrier layer 220 has good barrier effect with regard to oxygen and to flavors.

More preferably, the multi-layer polymeric material 200 comprises tie layers 221 on both side of each barrier layer 220. These tie layers 221 improve the bonding between the barrier layer and the adjacent inner layers 210.

More preferably, the multi-layer polymeric material comprises 2n barrier layers 220.

Advantageously, one specific type of PE represents at least 60% in mass of the multi-layer polymeric material 200. This ratio allows to pass into recyclability channel of said type of PE.

The following structures are exemplary embodiments of multi-layer polymeric material 200 according to the present invention. The invention is not restricted to the specific multi-layer polymeric material of the exemplary embodiments but encompasses other multi-layer polymeric material structures falling within the scope of the appended claims.

The different layers of these exemplary embodiments of laminated material are described starting from the external surface layer, i.e. the intended outer surface uppermost, to the internal surface layer, i.e. the intended inner (product-contacting) surface lowermost.

Example 1

This example corresponds to the embodiment schematically represented at FIG. 6. Said example 1 is constituted of:

- a first surface layer 201 made of MDPE, and having a thickness of 55 μm,
- a first inner layer 210 comprising MDPE, LLDPE and pigments, and having a thickness of 16 μm
- a tie layer 221 having a thickness of 8 μm
- a first non-metallic barrier layer 220 made of EVOH, and having a thickness of 8 μm,
- a tie layer 221 having a thickness of 8 μm,
- a second inner layer 210 comprising MDPE, LLDPE, pigments, and having a thickness of 16 μm
- a central layer 211 made of two sub-layers 211*a* of LLDPE having each a thickness of 14 μm,
- a third inner layer 210 comprising MDPE, LLDPE, pigments, and having a thickness of 16 μm,
- a tie layer 221 having a thickness of 8 μm
- a second non-metallic barrier layer 220 made of EVOH, and having a thickness of 8 μm,
- a tie layer 221 having a thickness of 8 μm,
- a fourth inner layer 210 comprising MDPE, LLDPE and pigments, and having a thickness of 16 μm
- a second surface layer 201 made of MDPE, and having a thickness of 55 μm.

Example 2

This example corresponds to the embodiment schematically represented at FIG. 7. Said example 2 is constituted of:

- a first surface layer 201 made of MDPE, and having a thickness of 13 μm,
- a first inner layer 210 made of two sub-layers 210*a* comprising HDPE, LDPE and pigments, and having a thickness respectively of 35 μm and 5 μm,
- a tie layer 221 having a thickness of 5 μm
- a first non-metallic barrier layer 220 made of EVOH, and having a thickness of 8 μm, a tie layer 221 having a thickness of 5 μm,
a second inner layer 210 made of two sub-layers 210*a* comprising HDPE, LDPE, pigments, and having a thickness respectively of 5 μm and 35 μm,
a central layer 211 made of two sub-layers 211*a* of LDPE having each a thickness of 14 μm,
a third inner layer 210 made of two sub-layers 210*a* comprising HDPE, LDPE, pigments, and having a thickness respectively of 35 μm and 5 μm,
a tie layer 221 having a thickness of 5 nm
a second non-metallic barrier layer 220 made of EVOH, and having a thickness of 8 nm,
a tie layer 221 having a thickness of 5 nm,
a fourth inner layer 210 made of two sub-layers 210*a* comprising HDPE, LDPE, pigments, and having a thickness respectively of 5 μm and 35 nm,
a second surface layer 201 made of MDPE, and having a thickness of 13 μm.

Example 3

This example corresponds to the embodiment schematically represented at FIG. 7. Said example 3 is constituted of:
a first surface layer 201 made of MDPE, and having a thickness of 11 μm,
a first inner layer 210 made of two sub-layers 210*a* comprising HDPE, LDPE and pigments, and having respectively a thickness of 33 μm and 5 μm,
a tie layer 221 having a thickness of 6 μm
a first non-metallic barrier layer 220 made of EVOH, and having a thickness of 10 μm,
a tie layer 221 having a thickness of 6 μm,
a second inner layer 210 made of two sub-layers 210*a* comprising HDPE, LDPE, pigments, and having a thickness respectively of 5 μm and 35 μm,
a central layer 211 made of two sub-layers 211*a* of LDPE having each a thickness of 14 μm,
a third inner layer 210 made of two sub-layers 210*a* comprising HDPE, LDPE, pigments, and having a thickness respectively of 35 μm and 5 μm,
a tie layer 221 having a thickness of 6 μm
a second non-metallic barrier layer 220 made of EVOH, and having a thickness of 10 μm,
a tie layer 221 having a thickness of 6 μm,
a fourth inner layer 210 made of two sub-layers 210*a* comprising HDPE, LDPE, pigments, and having a thickness respectively of 5 μm and 33 μm,
a second surface layer 201 made of MDPE, and having a thickness of 11 μm.

Example 4

This example corresponds to the embodiment schematically represented at FIG. 7. Said example 4 is constituted of:
a first surface layer 201 made of MDPE, and having a thickness of 10 μm,
a first inner layer 210 made of two sub-layers 210*a* comprising HDPE and pigments, and having respectively a thickness of 25.5 μm and 10 μm,
a tie layer 221 having a thickness of 5 μm
a first non-metallic barrier layer 220 made of EVOH, and having a thickness of 8 μm,
a tie layer 221 having a thickness of 5 μm,
a second inner layer 210 made of two sub-layers 210*a* comprising HDPE and pigments, and having a thickness respectively of 10 μm and 25.5 μm,
a central layer 211 made of two sub-layers 211*a* of C8 plastomer having each a thickness of 11 μm,
a third inner layer 210 made of two sub-layers 210*a* comprising HDPE and pigments, and having a thickness respectively of 25.5 μm and 10 μm,
a tie layer 221 having a thickness of 5 μm
a second non-metallic barrier layer 220 made of EVOH, and having a thickness of 8 μm,
a tie layer 221 having a thickness of 5 μm,
a fourth inner layer 210 made of two sub-layers 210*a* comprising HDPE and pigments, and having a thickness respectively of 10 μm and 25.5 μm,
a second surface layer 201 made of MDPE, and having a thickness of 10 μm.

Example 5

This example corresponds to the embodiment schematically represented at FIG. 6. Said example 5 is constituted of:
a first surface layer 201 made of MDPE, and having a thickness of 10 μm,
a first inner layer 210 comprising HDPE and pigments, and having a thickness of 24.4 μm,
a supplemental inner layer comprising HDPE, and having a thickness of 10.3 μm,
a tie layer 221 having a thickness of 4.95 μm
a first non-metallic barrier layer 220 made of EVOH, and having a thickness of 8 μm,
a tie layer 221 having a thickness of 4.95 μm,
a supplemental inner layer comprising HDPE, and having a thickness of 10.3 μm,
a second inner layer 210 comprising HDPE and pigments, and having a thickness of 24.4 μm,
a central layer 211 made of two sub-layers 211*a* of polyolefin plastomer having each a thickness of 12.7 μm,
a third inner layer 210 comprising HDPE and pigments, and having a thickness of 24.4 μm,
a supplemental inner layer comprising HDPE, and having a thickness of 10.3 μm,
a tie layer 221 having a thickness of 4.95 μm
a second non-metallic barrier layer 220 made of EVOH, and having a thickness of 8 μm,
a tie layer 221 having a thickness of 4.95 μm,
a supplemental inner layer comprising HDPE, and having a thickness of 10.3 μm,
a fourth inner layer 210 comprising HDPE and pigments, and having a thickness of 24.4 μm,
a second surface layer 201 made of MDPE, and having a thickness of 10 μm.

Example 6

This example corresponds to the embodiment schematically represented at FIG. 7. Said example 6 is constituted of:
a first surface layer 201 made of MDPE, and having a thickness of 10 μm,
a first inner layer 210 made of two sub-layers 210*a* comprising HDPE and pigments, and having respectively a thickness of 23 μm and 8 μm,
a tie layer 221 having a thickness of 5 μm
a first non-metallic barrier layer 220 made of EVOH, and having a thickness of 8 μm,
a tie layer 221 having a thickness of 5 μm,
a second inner layer 210 made of two sub-layers 210*a* comprising HDPE and pigments, and having a thickness respectively of 8 μm and 23 μm, a central layer 211 made of two sub-layers 211*a* of C8 plastomer having each a thickness of 10 μm, a third inner layer 210 made of two sub-layers 210*a* comprising HDPE and pigments, and having a thickness respectively of 23 μm and 8 μm, a tie layer 221 having a thickness of 5 μm a second non-metallic barrier layer 220 made of EVOH, and having a thickness of 8 μm, a tie layer 221 having a thickness of 5 μm, a fourth inner layer 210 made of two sub-layers 210*a* comprising HDPE and pigments, and having a thickness respectively of 8 μm and 23 μm, a second surface layer 201 made of MDPE, and having a thickness of 10 μm.

The following structures are comparative exemplary embodiments of multi-layer polymeric material.

The different layers of these comparative exemplary embodiments of laminated material are described starting from the external surface layer, i.e. the intended outer surface uppermost, to the internal surface layer, i.e. the intended inner (product-contacting) surface lowermost.

Comparative Example 1 a first surface layer made of LLDPE, and having a thickness of 30 μm, a first inner layer made of two sub-layers comprising HDPE and pigments, and having a thickness respectively of 33 μm and 42 μm, a second inner layer comprising LDPE, and having a thickness of 25 μm a tie layer having a thickness of 10 μm a non-metallic barrier layer made of EVOH, and having a thickness of 15 μm, a tie layer having a thickness of 10 μm, a third inner layer comprising HDPE and pigments, and having a thickness of 25 μm a second surface layer made of LLDPE, and having a thickness of 60 μm.

Comparative Example 2 a first surface layer made of MDPE, and having a thickness of 60 μm, a first inner layer comprising HDPE and pigments, and having a thickness of 29 μm a second inner layer comprising MDPE and pigments, and having a thickness of 20 μm a tie layer having a thickness of 8 μm a non-metallic barrier layer made of EVOH, and having a thickness of 16 μm, a tie layer having a thickness of 8 μm, a third inner layer comprising MDPE and pigments, and having a thickness of 20 μm a fourth inner layer comprising HDPE and pigments, and having a thickness of 29 μm a second surface layer made of MDPE, and having a thickness of 60 μm.

Comparative Example 3 a first surface layer made of MDPE, and having a thickness of 27 μm, a first inner layer made of two sub-layers 2 comprising HDPE and pigments, and having a thickness respectively of 70 μm and 10 μm, a tie layer having a thickness of 10 μm a non-metallic barrier layer made of EVOH, and having a thickness of 16 μm, a tie layer having a thickness of 10 μm, a second inner layer made of two sub-layers comprising HDPE and pigments, and having a thickness respectively of 10 μm and 70 μm, a second surface layer made of MDPE, and having a thickness of 27 μm.

The invention claimed is:

1. A flexible tube container comprising:

a tube head; and a skirt formed from a multi-layer polymeric material produced as a blown film, the skirt comprising a longitudinal weld or join, the multi-layer polymeric material comprising a thickness of between 200 and 400 micrometers, said multi-layer polymeric material comprising two polyethylene (PE) based surface layers, at least two non-metallic barrier layers, and a plurality of PE based inner layers between said surface layers, wherein the multi-layer polymeric material comprises pigments in several inner layers.

2. The flexible tube container according to claim 1, wherein the multi-layer polymeric material has a symmetrical structure with respect to its median plane.

3. The flexible tube container according to claim 1, wherein the pigments are distributed in 2n inner layers, n being an integer.

4. The flexible tube container according to claim 1, wherein the multi-layer polymeric material comprises from 3% to 7% in mass of pigment.

5. The flexible tube container according to claim 1, wherein the surface layers are made of MDPE.

6. The flexible tube container according to claim 1, wherein each inner layer comprise mixture of different type of polyethylene, a ratio of different type of polyethylene being selected in order to balance a moisture barrier effect and a processability.

7. The flexible tube container according to claim 1, wherein the inner layers comprise mixture of LLDPE and MDPE.

8. The flexible tube container according to claim 1, wherein the inner layers comprise mixture of LDPE and HDPE.

9. The flexible tube container according to claim 1, wherein each inner layer comprise HDPE.

10. The flexible tube container according to claim 1, wherein the at least two non-metallic barrier layers are made of EVOH.

11. The flexible tube container according to claim 1, wherein the multi-layer polymeric material comprises 2n barrier layers.

12. The flexible tube container according to claim 1, wherein the multi-layer polymeric material comprises tie layers on both side of each barrier layer.

13. The flexible tube container according to claim 1, wherein the multi-layer polymeric material comprises pigments in each inner layer.

14. The flexible tube container according to claim 1, wherein one specific type of PE represents at least 60% in mass of the multi-layer polymeric material.

* * * * *